US010968718B2

(12) United States Patent
Neufeld et al.

(10) Patent No.: US 10,968,718 B2
(45) Date of Patent: Apr. 6, 2021

(54) SEAL HOUSING WITH FLANGE COLLAR, FLOATING BUSHING, SEAL COMPRESSOR, FLOATING POLISHED ROD, AND INDEPENDENT FLUID INJECTION TO STACKED DYNAMIC SEALS, AND RELATED APPARATUSES AND METHODS OF USE

(71) Applicant: PCM CANADA INC, Lloydminster (CA)

(72) Inventors: Peter Neufeld, Sherwood Park (CA); Ronny Neufeld, Edmonton (CA); Sejad Karalic, Edmonton (CA); Andrew Gowenlock, Edmonton (CA)

(73) Assignee: PCM CANADA INC., Lloydminster (CA)

( * ) Notice: Subject to any disclaimer, the term of this patent is extended or adjusted under 35 U.S.C. 154(b) by 164 days.

(21) Appl. No.: 15/984,289

(22) Filed: May 18, 2018

(65) Prior Publication Data

US 2019/0063176 A1 Feb. 28, 2019

(30) Foreign Application Priority Data

May 18, 2017 (CA) ..... CA 2967606

(51) Int. Cl.
*E21B 33/08* (2006.01)
*E21B 43/12* (2006.01)

(52) U.S. Cl.
CPC ..... *E21B 33/085* (2013.01); *E21B 43/126* (2013.01)

(58) Field of Classification Search
CPC ..... E21B 33/085; E21B 43/126
See application file for complete search history.

(56) References Cited

U.S. PATENT DOCUMENTS

| | | | |
|---|---|---|---|
| 1,484,362 | A | 5/1922 | Stone |
| 1,678,307 | A | 1/1924 | Stone |
| 1,976,200 | A | 4/1931 | Swanson |

(Continued)

FOREIGN PATENT DOCUMENTS

| | | |
|---|---|---|
| BR | 9504043 | 10/1997 |
| CA | 2074013 | 1/1994 |

(Continued)

OTHER PUBLICATIONS

Rineer Hydraul, Rineer Hydraulics: Engineered to Deliver More Power Where You Need It, accessed Jun. 25, 2018, catalogue, believed to be available as early as 2005, 6 pages, San Antonio, TX.

(Continued)

*Primary Examiner* — Michael R Wills, III
(74) *Attorney, Agent, or Firm* — Stephen M. De Klerk

(57) ABSTRACT

Seal housings with flange collars, floating bushings, seal compressors, floating polished rods, independent fluid injection to stacked dynamic seals, and related apparatuses and methods of use. Embodiments are described that permit the polished rod to float within a tubular shaft, and the tubular shaft to float within a stationary housing, of a seal housing, to permit the seal housing to accommodate rod deviation from center. Flange collars are provided to facilitate the interconnection between seal housings and driveheads that previously were incompatible with one another.

18 Claims, 8 Drawing Sheets

(56) References Cited

U.S. PATENT DOCUMENTS 2,491,599 A 8/1947 Allen
2,471,198 A 3/1948 Cormany
3,016,020 A 1/1962 Rineer
3,364,523 A 1/1968 Schrippers
3,672,797 A 6/1972 Gerlach
3,891,031 A 6/1975 Ortiz
3,957,404 A 5/1976 Gerlach
3,976,407 A 8/1976 Gerlach
4,150,727 A 4/1979 Shepherd
4,246,976 A 1/1981 McDonald, Jr.
4,314,611 A 2/1982 Willis
4,342,537 A 8/1982 Goyne
4,372,379 A 2/1983 Kulhanek et al.
4,419,015 A * 12/1983 Liddiard ..... B01F 15/00694 277/511
4,423,645 A 1/1984 Abbott et al.
4,475,872 A 10/1984 Foughty
4,511,307 A 4/1985 Drake
4,599,058 A 7/1986 Stone
4,797,075 A 1/1989 Edwards et al.
4,800,771 A 1/1989 Edwards et al.
4,927,333 A 5/1990 Kato
4,993,276 A 2/1991 Edwards
4,997,346 A 3/1991 Bohon
5,244,183 A 9/1993 Calvin et al.
5,355,993 A 10/1994 Hay
5,358,036 A 10/1994 Mills
5,370,179 A 12/1994 Mills
5,470,215 A 11/1995 Stone
5,626,345 A * 5/1997 Wallace ..... F16J 15/008 277/309
5,628,516 A 5/1997 Grenke
5,791,411 A 8/1998 Ricalton et al.
5,823,541 A 10/1998 Dietle et al.
6,076,259 A 6/2000 Moss et al.
6,135,716 A 10/2000 Billdal et al.
6,152,231 A 11/2000 Grenke
6,206,097 B1 3/2001 Stephens
6,227,547 B1 5/2001 Dietle et al.
6,241,016 B1 6/2001 Dedels
6,253,844 B1 7/2001 Walker
6,305,918 B2 10/2001 Turiansky
6,312,238 B1 11/2001 Gerlach
6,315,302 B1 11/2001 Conroy
6,371,487 B1 4/2002 Cimbura, Sr.
6,419,472 B2 7/2002 Kobensen
6,497,281 B2 12/2002 Vann
6,543,533 B2 4/2003 Meek et al.
6,557,643 B1 5/2003 Hall et al.
6,564,911 B2 5/2003 Mills
6,572,339 B2 6/2003 Walton et al.
6,581,379 B2 6/2003 Nomura et al.
6,595,278 B1 7/2003 Lam et al.
6,786,309 B2 9/2004 Saruwatari et al.
6,843,313 B2 1/2005 Hult
6,928,922 B2 8/2005 Nagai et al.
7,044,217 B2 5/2006 Hult
7,086,473 B1 8/2006 Bangash
7,118,114 B2 10/2006 Burdick et al.
7,201,238 B2 4/2007 Marvin et al.
7,255,163 B2 8/2007 Rivard
7,530,800 B2 5/2009 Sieben
7,553,139 B2 6/2009 Amburgey et al.
7,575,413 B2 8/2009 Semple et al.
7,669,650 B2 * 3/2010 Cayford ..... F16J 15/18 166/68.5
7,721,805 B2 5/2010 Hill et al.
7,748,445 B2 7/2010 Wells et al.
7,806,665 B2 10/2010 Mello et al.
7,874,369 B2 * 1/2011 Parker ..... F04C 2/1073 166/379
7,926,559 B2 4/2011 Salloum
8,066,496 B2 11/2011 Brown
8,074,999 B2 12/2011 Burdick et al.
8,132,618 B2 3/2012 Blaquiere
8,246,052 B1 8/2012 Marvel, III
8,419,387 B1 4/2013 Karbs et al.
8,419,390 B2 4/2013 Merrill et al.
8,491,278 B2 7/2013 Mello et al.
8,499,842 B2 8/2013 Nguyen et al.
8,528,650 B1 9/2013 Smith et al.
8,544,535 B2 10/2013 Cote et al.
8,550,218 B2 10/2013 Villa et al.
8,662,186 B2 3/2014 Robles
8,794,306 B2 8/2014 Cote et al.
8,870,187 B2 10/2014 Murray
8,899,314 B2 12/2014 Tebay
8,950,485 B2 2/2015 Wilkins et al.
8,955,582 B2 2/2015 Wang et al.
8,955,650 B2 2/2015 Villa et al.
9,016,362 B2 4/2015 Hult
9,027,717 B2 5/2015 Hult
9,085,970 B2 7/2015 Xiao et al.
9,127,545 B2 9/2015 Kajaria et al.
9,163,679 B1 10/2015 Shen
9,181,996 B2 11/2015 Klotz et al.
9,194,509 B2 11/2015 Adams et al.
9,291,023 B2 3/2016 McGilvary, Jr. et al.
9,316,319 B2 4/2016 Dietle
9,322,238 B2 4/2016 Hult
9,334,908 B2 5/2016 Tickner et al.
9,347,585 B2 5/2016 Helvenston et al.
9,366,119 B2 6/2016 Hall et al.
9,429,238 B2 8/2016 Richie et al.
9,441,683 B2 9/2016 Shen
9,447,671 B2 9/2016 Nguyen et al.
9,458,688 B2 10/2016 Adkinson et al.
9,458,699 B2 10/2016 Monjure et al.
9,500,294 B2 11/2016 Herman et al.
9,534,465 B2 1/2017 Nguyen et al.
9,611,717 B2 4/2017 Lockwood
9,624,747 B2 4/2017 Kajaria et al.
9,695,663 B2 7/2017 Borak, Jr. et al.
9,765,606 B2 9/2017 Snow et al.
9,835,481 B2 12/2017 Edwards et al.
9,845,434 B2 12/2017 Pinappu et al.
9,845,879 B2 12/2017 Dietle et al.
9,869,150 B2 1/2018 Cote et al.
9,879,520 B2 1/2018 Fanini et al.
9,879,529 B2 1/2018 Scholz et al.
9,879,771 B2 1/2018 Campbell
9,903,187 B2 2/2018 Robison et al.
9,909,381 B2 3/2018 Kajaria et al.
9,920,601 B2 3/2018 Carrejo et al.
9,963,936 B2 5/2018 Kruspe et al.
9,976,227 B2 5/2018 Wangenheim et al.
9,976,385 B2 5/2018 Banerjee
9,995,099 B2 6/2018 Halfmann
10,000,995 B2 6/2018 Bishop et al.
10,006,282 B2 6/2018 Livescu et al.
10,018,034 B2 7/2018 Chronister
10,035,083 B2 7/2018 Ochoa
10,036,224 B2 7/2018 Borak
10,036,237 B2 7/2018 O'Brien et al.
10,036,389 B2 7/2018 Li et al.
10,047,584 B2 8/2018 Stowe et al.
10,077,616 B2 9/2018 Stachowiak, Jr.
2002/0175029 A1 11/2002 Saruwatari et al.
2003/0184019 A1 10/2003 Rimmer
2003/0205864 A1 11/2003 Dietle et al.
2006/0032635 A1 2/2006 Rivard
2006/0048947 A1 3/2006 Hall et al.
2007/0292277 A1 12/2007 Grenke
2008/0060819 A1 3/2008 Blaquiere
2008/0106045 A1 * 5/2008 Lembcke ..... F16J 15/3436 277/639
2008/0122182 A1 5/2008 Parker et al.
2008/0142209 A1 6/2008 Mello et al.
2008/0135358 A1 10/2008 Villa et al.
2013/0045116 A1 2/2013 Wang et al.
2015/0136384 A1 5/2015 Stachowiak, Jr.
2015/0240586 A1 8/2015 Sherrill
2015/0330169 A1 11/2015 Coutts, Jr. et al.
2017/0009539 A1 1/2017 Helvenston et al.

(56) References Cited

U.S. PATENT DOCUMENTS

| | | | |
|---|---|---|---|
| 2017/0009549 | A1 | 1/2017 | Bhatnagar |
| 2017/0037848 | A1 | 2/2017 | Robison et al. |
| 2017/0184123 | A1 | 6/2017 | Nelson et al. |
| 2017/0191333 | A1 | 7/2017 | Lewis et al. |
| 2017/0247956 | A1 | 8/2017 | Estrada et al. |
| 2017/0248150 | A1 | 8/2017 | Nelson et al. |
| 2017/0248151 | A1 | 8/2017 | Nelson et al. |
| 2017/0248157 | A1 | 8/2017 | Loveless |
| 2017/0292342 | A1 | 10/2017 | Reeves et al. |
| 2017/0321493 | A1 | 11/2017 | Reeves et al. |
| 2017/0331411 | A1 | 11/2017 | Kitano et al. |
| 2017/0351959 | A1 | 12/2017 | Rasheed et al. |
| 2018/0051555 | A1 | 2/2018 | Marvel et al. |
| 2018/0106146 | A1 | 4/2018 | Scholz et al. |
| 2018/0172008 | A1 | 6/2018 | Knapp et al. |
| 2018/0202271 | A1 | 7/2018 | Semple et al. |

FOREIGN PATENT DOCUMENTS

| | | |
|---|---|---|
| CA | 2095473 | 11/1994 |
| CA | 2095937 | 11/1994 |
| CA | 2098324 | 12/1994 |
| CA | 2232175 | 3/1997 |
| CA | 2239641 | 6/1998 |
| CA | 2288479 | 5/2001 |
| CA | 2309545 | 11/2001 |
| CA | 2311214 | 12/2001 |
| CA | 2350047 | 12/2001 |
| CA | 2710783 | 12/2001 |
| CA | 2716430 | 12/2001 |
| CA | 2347942 | 11/2002 |
| CA | 2522257 | 10/2004 |
| CA | 2455742 | 7/2005 |
| CA | 2515616 | 2/2006 |
| CA | 2613630 | 6/2008 |
| CA | 2550066 | 8/2011 |
| CA | 2805584 | 8/2013 |
| CA | 2788310 | 2/2014 |
| CA | 2825508 | 2/2014 |
| CA | 2831233 | 4/2014 |
| CA | 2919886 | 2/2015 |
| CA | 2964077 | 6/2016 |
| CN | 1079499 | 12/1993 |
| CN | 1145456 | 3/1997 |
| GB | 805453 | 7/1956 |
| GB | 794470 | 5/1958 |
| GB | 811270 | 4/1959 |
| HU | 219961 | 10/2001 |
| MX | 9801983 | 4/1997 |
| WO | 9710437 | 3/1997 |

OTHER PUBLICATIONS

Weatherford, Basics in Progressing Cavity Pumping Systems: Surface Components, slide show presentation, 2004, 13 pages, Weatherford.

Bosch Rexroth Rineer Hydraulic Vane High Torque Motors—ETS, URL = https://www.etshydro.com/rineer-hydraulic-motors/ , accessed Oct. 26, 2018, believed to be available as of the priority date, 10 pages.

Vane Pumps—Chemical Engg Info, URL = http://chemicalengginfo.org/2017/06/15/vane-pumps/, accessed Oct. 26, 2018, believed to be available as early as priority date, 5 pages.

* cited by examiner

SEAL HOUSING WITH FLANGE COLLAR, FLOATING BUSHING, SEAL COMPRESSOR, FLOATING POLISHED ROD, AND INDEPENDENT FLUID INJECTION TO STACKED DYNAMIC SEALS, AND RELATED APPARATUSES AND METHODS OF USE

TECHNICAL FIELD

This document relates to seal housings with flange collars, floating bushings, seal compressors, floating polished rods, independent fluid injection to stacked dynamic seals, and related apparatuses and methods of use.

BACKGROUND

Stuffing boxes are used in the oilfield to form a seal between the wellhead and a well tubular passing through the wellhead, in order to prevent leakage of wellbore fluids between the wellhead and the piping. Stuffing boxes may be used in a variety of applications, for example production with a surface drives such as a pump-jack or a drive head. Stuffing boxes exist that incorporate a tubular shaft mounted in the housing to rotate and seal with the polished rod while forming a dynamic or rotary seal with the housing. Designs of this type of stuffing box can be seen in U.S. Pat. No. 7,044,217 and CA 2,350,047.

Leakage of crude oil from a stuffing box is common in many production applications, due to a variety of reasons including wear from abrasive particles present in crude oil and poor alignment between the wellhead and stuffing box. Leakage costs oil companies' money in service time, downtime and environmental clean-up. It is especially a problem in heavy crude oil wells in which oil may be produced from semi-consolidated sand formations where loose sand is readily transported to the stuffing box by the viscosity of the crude oil. Costs associated with stuffing box failures are some of the highest maintenance costs on many wells.

The integral stuffing box assembly is a system used to reduce wear on seals. At an oil and gas production well, a drive head may be mounted directly on top of a stuffing box above a well head. A polished rod is connected to be rotated by the drive head, and extends through the seal housing into the well, where the polished rod rotates a progressive cavity pump downhole to lift well fluids such as oil from the well. A tubular shaft in the stuffing box forms a dynamic seal with the polished rod as the polished rod rotates within the stuffing box.

SUMMARY

An apparatus is disclosed comprising: a stationary housing defining a polished rod passage; a flange collar mounted to the stationary housing and defining an array of bolt holes for connecting to a drive head; a tubular shaft mounted to the flange collar to rotate within the polished rod passage relative to the stationary housing; and a dynamic seal mounted to the stationary housing encircling the tubular shaft within the polished rod passage.

A method is also disclosed comprising: mounting a stationary housing to a wellhead at a top of a well that penetrates a subterranean formation, in which a flange collar is mounted on a top end of the stationary housing, a tubular shaft is mounted to the flange collar to rotate within the stationary housing, and a dynamic seal encircles the tubular shaft within the stationary housing; mounting a drive head to the flange collar; and operating the drive head to rotate a polished rod, which passes through the tubular shaft and stationary housing, to pump fluid from the well.

An apparatus is also disclosed comprising: a stationary housing defining a polished rod passage; a tubular shaft mounted to rotate within the polished rod passage relative to the stationary housing; a dynamic seal mounted to the stationary housing encircling the tubular shaft within the polished rod passage; and in which the tubular shaft is mounted to the apparatus at an anchor point that is at, near, or above, a top end of the stationary housing, with a free base end of the tubular shaft depending from the anchor point to float in radial directions within the polished rod passage.

A method is also disclosed comprising: mounting a stationary housing defining a polished rod passage to a wellhead at a top of a well that penetrates a subterranean formation, in which a tubular shaft is mounted to rotate within the stationary housing, and a dynamic seal mounted to the stationary housing encircles the tubular shaft within the stationary housing; mounting a drive head to the stationary housing; and operating the drive head to rotate a polished rod, which passes through the tubular shaft and stationary housing, to pump fluid from the well; in which a free base end of the tubular shaft floats in radial directions within the polished rod passage in response to contact with the polished rod.

An apparatus is also disclosed comprising: a stationary housing defining a polished rod passage; a tubular shaft mounted to rotate within the polished rod passage relative to the stationary housing; a dynamic seal mounted to the stationary housing encircling the tubular shaft within the polished rod passage; and a seal compressor part mounted, within the polished rod passage, to the stationary housing by a threaded fastener, such that as the threaded fastener is advanced, the seal compressor part contacts and applies an axial force upon the dynamic seal to compress the dynamic seal radially inward against the tubular shaft.

A method is also disclosed comprising: advancing a threaded fastener to move a seal compressor part to apply an axial force upon a dynamic seal to compress the dynamic seal radially inward against a tubular shaft, which is mounted to rotate within a stationary housing, which is mounted to a wellhead at a top of a well that penetrates a subterranean formation; mounting a drive head to the stationary housing; and operating the drive head to rotate a polished rod, which passes through the tubular shaft and stationary housing, to pump fluid from the well.

An apparatus is also disclosed comprising: a stationary housing defining a polished rod passage; a tubular shaft mounted to rotate within the polished rod passage relative to the stationary housing; a dynamic seal mounted to the stationary housing encircling the tubular shaft within the polished rod passage; a drive head mounted to the stationary housing; a polished rod extended from the drive head through the tubular shaft, with the drive head being connected to rotate the polished rod; and in which an interior of the tubular shaft is oversized to permit the polished rod to float in radial directions within the tubular shaft.

An apparatus is also disclosed comprising: a stationary housing defining a polished rod passage; a tubular shaft mounted to rotate within the polished rod passage relative to the stationary housing; dynamic seals are mounted to the stationary housing encircling the tubular shaft within the polished rod passage; and in which: the dynamic seals are stacked axially one on top of the other; each of the dynamic seals comprise a retainer ring that mounts an annular lip seal; each retainer ring has a respective radial passage extending between an outer cylindrical wall and an inner cylindrical wall of the retainer ring; and fluid injection ports each extend from an external surface of the stationary housing into fluid communication with a respective annular seal cavity defined between the tubular shaft, the inner cylindrical wall of the respective retainer ring, and the respective annular lip seal.

In various embodiments, there may be included any one or more of the following features: The flange collar comprises a rolling element bearing that mounts the tubular shaft to the flange collar, the rolling element bearing having a moving part and a stationary part. The rolling element bearing comprises: an inner race as the moving part; an outer race as the stationary part; and rollers or balls. The flange collar has a top face and a base face; the array of bolt holes is arranged on the top face; and the flange collar is bolted to the stationary housing using corresponding second arrays of bolt holes arranged on the flange collar and the stationary housing. The array of bolt holes is incompatible with the second arrays. Relative to the second arrays, the array of bolt holes has one or more of: a wider or narrower radius; and a larger or smaller angular spacing between respective bolt holes such that less than fifty percent of the bolt holes in the second arrays align with the bolt holes of the array of bolt holes. The tubular shaft comprises a wear sleeve contacting the dynamic seal. The tubular shaft defines or mounts a drive head drive shaft connector. The drive head drive shaft connector comprises drive-shaft-finger-receiving key slots. A drive head is bolted to the flange collar; a polished rod extends from the drive head through the tubular shaft and polished rod passage; and the drive head is connected to rotate the polished rod. An interior of the tubular shaft is oversized to permit the polished rod to float in radial directions within the tubular shaft. The polished rod is mounted to the drive head independent of the tubular shaft. A central axis of the polished rod defines a non-zero angle with a central axis of the tubular shaft. The polished rod is connected to operate a progressive cavity pump located with a well below the apparatus. A method comprising operating a drive head, which is mounted to the apparatus to rotate a polished rod and pump fluid from a well. Mounting the stationary housing comprises bolting the flange collar to the stationary housing; and mounting the drive head comprises bolting the drive head to the flange collar. The drive head bolts to the flange collar using corresponding first arrays of bolt holes arranged on the drive head and flange collar; the flange collar bolts to the stationary housing using corresponding second arrays of bolt holes arranged on the flange collar and the stationary housing; and the first arrays are incompatible with the second arrays. Selecting, modifying, or constructing, the flange collar such that an array of bolt holes of the flange collar matches an array of bolt holes of the drive head to provide the corresponding first arrays of bolt holes. The tubular shaft is mounted to permit at least 4 thousandths of an inch of floating in radial directions measured from a central position. The tubular shaft is mounted at the anchor point to a rolling element bearing, the rolling element bearing having at least a moving part and a stationary part. The rolling element bearing is the only rolling element bearing that mounts the tubular shaft to the apparatus. The tubular shaft comprises an annular flange that rests axially on an upper shoulder of the rolling element bearing to hang the tubular shaft from the rolling element bearing. A flange collar mounted to the stationary housing, in which the tubular shaft is mounted at the anchor point to the flange collar. The flange collar is bolted to the stationary housing. An interior of the tubular shaft is oversized to permit the polished rod to float in radial directions within the tubular shaft. The polished rod is mounted to the drive head independent of the tubular shaft. A central axis of the polished rod defines a non-zero angle with a central axis of the tubular shaft. The polished rod is connected to operate a progressive cavity pump located with a well below the apparatus. The dynamic seal is sandwiched axially between a seal support shelf, of the stationary housing, and the seal compressor part. The seal compressor part comprises a collar. The collar comprises fastener apertures aligned with respective fastener receiving apertures defined within a collar shelf of the stationary housing. The dynamic seal is mounted within a first annular cavity defined between the tubular shaft, an interior surface of the stationary housing, and the seal support shelf; the collar is mounted within a second annular cavity defined between the tubular shaft, the interior surface of the stationary housing, and the collar shelf; the first annular cavity has a first radius; and the second annular cavity has a second radius that is greater than the first radius. The interior surface of the stationary housing is stepped such that in sequence the seal support shelf defines a base tread, the interior surface of the stationary housing of the first annular cavity defines a riser, and the collar shelf forms an upper tread. The dynamic seal comprises a retainer ring that mounts an annular lip seal. The retainer ring defines a radial passage extending between an outer cylindrical wall and an inner cylindrical wall of the retainer ring; and a fluid injection port extends from an external surface of the stationary housing into fluid communication with the radial passage. The retainer ring defines an annular groove within the outer cylindrical wall, the annular groove being in fluid communication with the aperture of the retainer ring and the fluid injection port. A fluid drain port extends from the external surface of the stationary housing into fluid communication with the radial passage. An annular seal cavity defined between the tubular shaft, the inner cylindrical wall of the retainer ring, and the annular lip seal, is pressurized with fluid. A plurality of dynamic seals stacked axially one on top of the other. Each of the plurality of dynamic seals comprise a retainer ring that mounts an annular lip seal; each retainer ring has a respective radial passage extending between an outer cylindrical wall and an inner cylindrical wall of the retainer ring; and the fluid injection port is one of a plurality of fluid injection ports that each extend from an external surface of the stationary housing into fluid communication with a respective annular seal cavity defined between the tubular shaft, the inner cylindrical wall of the respective retainer ring, and the respective annular lip seal. Prior to advancing, installing the dynamic seal and seal compressor part within the stationary housing around the tubular shaft. The dynamic seal comprises a retainer ring that mounts an annular lip seal. Pressurizing an annular seal cavity defined between the tubular shaft, an inner cylindrical wall of the retainer ring, and the annular lip seal, by injecting fluid through a fluid injection port that extends through the stationary housing into fluid communication with a radial passage extending between an outer cylindrical wall and the inner cylindrical wall of the retainer ring. Draining a portion of fluid from the annular seal cavity through the fluid injection port or a fluid drain port that extends through the stationary housing into fluid communication with the radial passage. Stacking a plurality of dynamic seals axially one on top of the other around the tubular shaft. Each of the plurality of dynamic seals comprise a retainer ring that mounts an annular lip seal; each retainer ring has a respective radial passage extending between an outer cylindrical wall and an inner cylindrical wall of the retainer ring; the fluid injection port is one of a plurality of fluid injection ports that each extend through the stationary housing into fluid communication with a radial passage of a respective retainer ring; and further comprising independently pressurizing a respective annular seal cavity defined between the tubular shaft, the inner cylindrical wall of a respective retainer ring, and the annular lip seal of the respective dynamic seal, by injecting fluid through each fluid injection port. Independently draining a portion of fluid from each respective annular seal cavity through the respective fluid injection port or a respective fluid drain port that extends through the stationary housing into fluid communication with the respective radial passage. Fluid drain ports each extend from the external surface of the stationary housing into fluid communication with a respective annular seal cavity defined between the tubular shaft, the inner cylindrical wall of the respective retainer ring, and the respective annular lip seal.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Immaterial modifications may be made to the embodiments described here without departing from what is covered by the claims.

Conventional stuffing boxes may leak and experience packing wear. With many progressive cavity pump installations the rod string may oftentimes not be perfectly straight, or may be angled. Additionally, the rod string tends to oscillate during rotation, which can exacerbate packing wear and may result in the escape of pressurized well fluid past seals.

Due to abrasive sand particles present in crude oil and poor alignment between the wellhead and stuffing box, leakage of crude oil from the stuffing box is common in some applications. Leakage may cost oil companies money in service time, down time and environmental cleanup. Leakage is especially a problem with heavy crude oil wells in which the oil is often produced from semi-consolidated sand formations since loose sand is readily transported to the stuffing box by the viscosity of the crude oil. It may be difficult to make stuffing boxes that last as long as desirable by oil production companies. Costs associated with stuffing box failures are one of the highest maintenance costs on many wells.

Figures 1A, 1B:
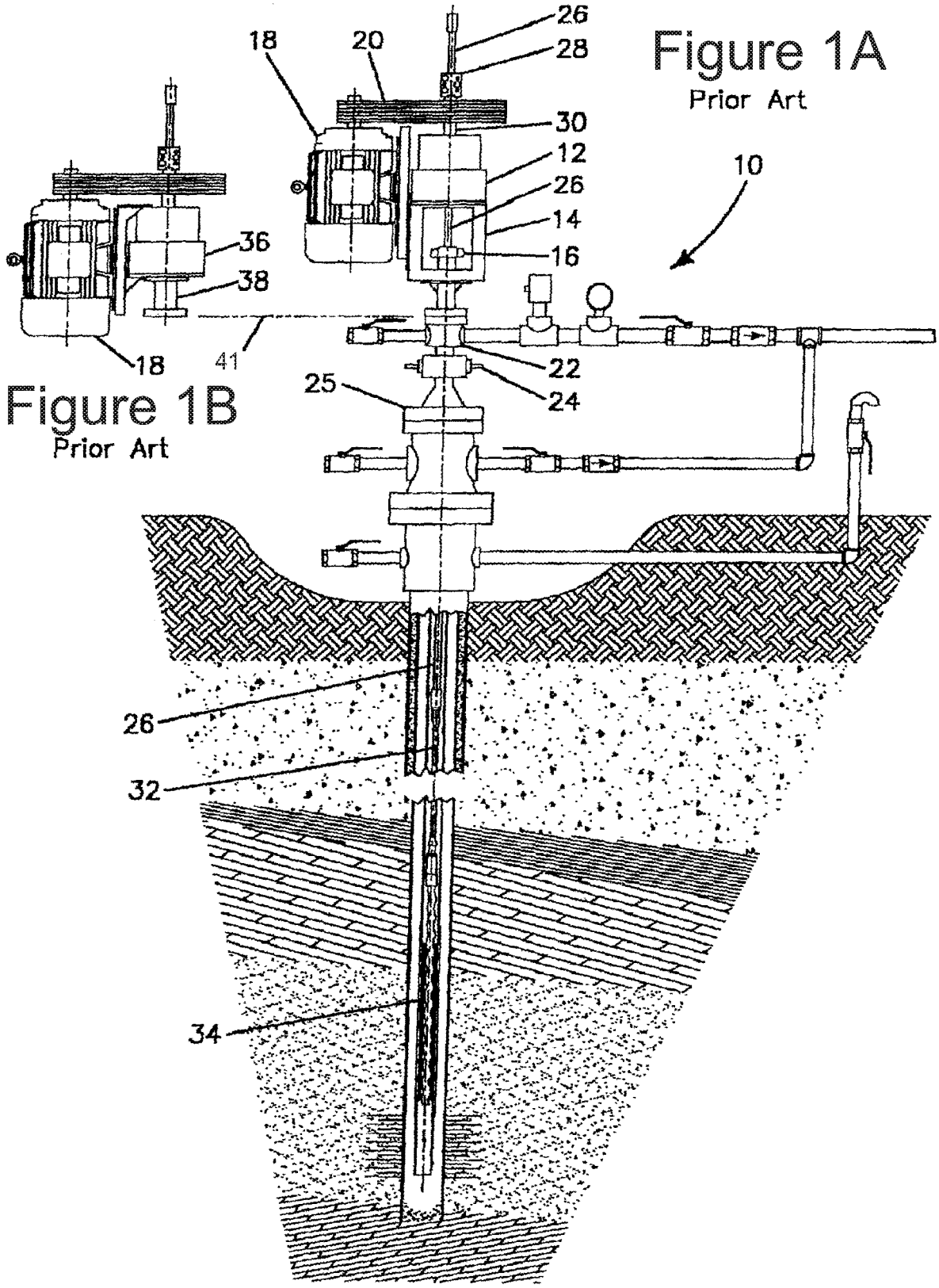
Figure 1A Prior Art
Figure 1B Prior Art
FIG. 1A is a view of a progressing cavity pump oil well installation in an earth formation for production with a typical drive head, wellhead frame and stuffing box.
FIG. 1B is a view similar to the upper end of FIG. 1 but illustrating a conventional drive head with an integrated stuffing box extending from the bottom end of the drive head.

FIG. 1A illustrates a known progressing cavity pump installation 10. The installation 10 includes a conventional progressing cavity pump drive head 12, a wellhead frame 14, a stuffing box 16, an electric motor 18, and a belt and sheave drive system 20, all mounted on a flow tee 22. The flow tee is shown with a blowout preventer 24 which is, in turn, mounted on a wellhead 25. The drive head 12 supports and drives a drive shaft, generally known as a polished rod 26. The polished rod is supported and rotated by means of a polish rod clamp 28, which engages an output shaft 30 of the drive head by means of milled slots (not shown) in both parts. The clamp 28 may prevent the polished rod from falling through the drive head and stuffing box, and may allow the drive head to support the axial weight of the polished rod. Wellhead frame 14 may be open-sided in order to expose polished rod 26 to allow a service crew to install a safety clamp on the polished rod and then perform maintenance work on stuffing box 16. Polished rod 26 rotationally drives a drive string 32, sometimes referred to as a sucker rod, which, in turn, drives a progressing cavity pump 34 located at the bottom of the installation to produce well fluids to the surface through the wellhead.

In order to reduce leakage, high-pressure lip seals have been used running against a hardened sleeve rather than against a polished rod. Canadian Patent No. 2,095,937 issued Dec. 22, 1998 discloses a typical stuffing box employing lip seals. Such stuffing boxes are known in the industry as environmental stuffing boxes because such do not leak until the lip seals fail. Since these high-pressure lip seals are not split and are mounted below the drive head, such seals cannot be replaced with the polished rod in place, meaning that the drive head must be removed to service the stuffing box. Since the drive head must be removed to service the lip seals, the wellhead frame has been eliminated and the stuffing box is bolted directly to the bottom of the drive head on many drive heads now being produced. This type of stuffing box directly mounted to the drive head is shown in the above referenced Grenke patent. This type of stuffing box is referred to as integral.

FIG. 1B illustrates a typical progressing cavity pump drive head 36 with an integral stuffing box 38 mounted on the bottom of the drive head and corresponding to the portion of the installation in FIG. 1A that is above the dotted and dashed line 41. An advantage of this type of drive head is that, since the main drive head shaft is already supported with bearings, stuffing box seals can be placed around the main shaft, thus improving alignment and eliminating contact between the stuffing box rotary seals and the polished rod. This style of drive head may also reduce the height of the installation because there is no wellhead frame, and also may reduce capital cost because there are fewer parts since the stuffing box is integrated with the drive head. A disadvantage is that the drive head must be removed to do maintenance work on the stuffing box. In addition, a top-mounted stuffing box may still be required above the drive head 36 to dynamically seal off the rod 26 from the ambient environment. Surface drive heads for progressing cavity pumps require a stuffing box to seal crude oil from leaking onto the ground where the polished rod passes from the crude oil passage in the wellhead to the drive head.

Servicing of stuffing boxes may be time consuming and difficult. In order to service an integral stuffing box, the drive head must be removed which may necessitate using a rig with two winch lines, one to support the drive head and the other to hold the polished rod. To save on rig time, the stuffing box may be replaced and the original stuffing box is sent back to a service shop for repair.

A top mounted stuffing box may be used to allow the stuffing box to be serviced from on top of the drive head without removing the drive head from the well. An example of such a stuffing box is shown in Hult's Canadian patent application 2,350,047. Such top mounted stuffing boxes may use a flexibly mounted standpipe around which are plural sets of bearings that support the shaft and carry rotary stuffing box seals. Typically, the primary rotary stuffing box seal is braided packing since it has proven to last for a long time when running against the hardened, flexibly mounted standpipe.

Figure 2:
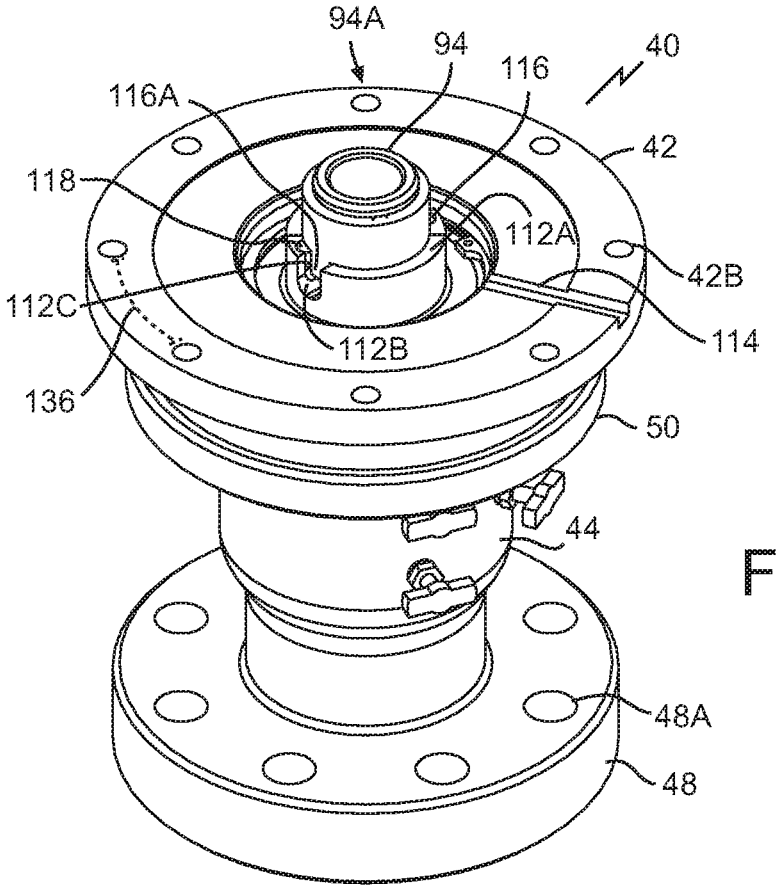
FIG. 2 is a perspective view of a seal housing for a drive head.
Figures 5, 5A:
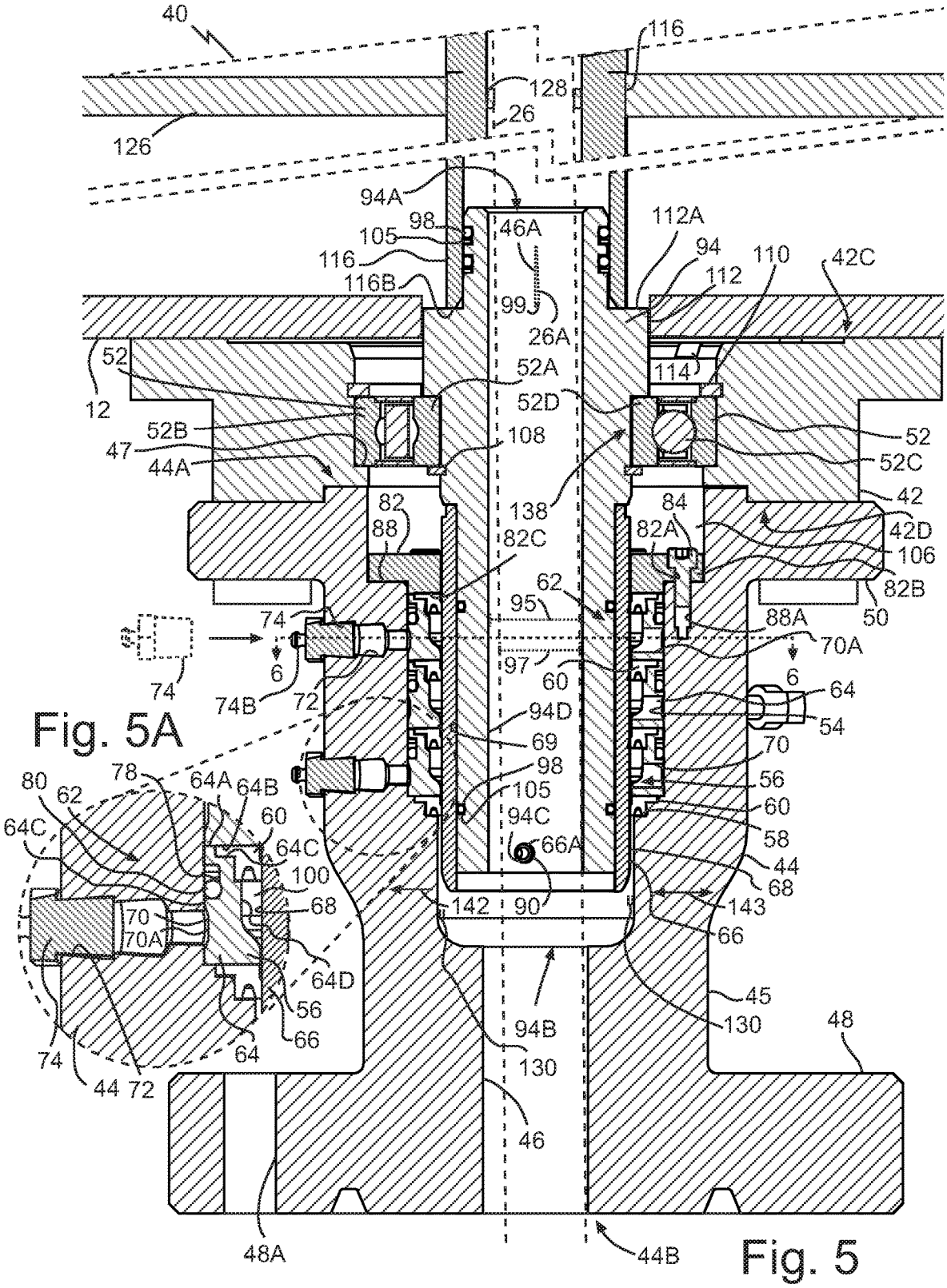
FIG. 5 is a view taken along the 5-5 section lines of FIG. 3.
FIG. 5A is a close up view of the area marked in dashed lines in FIG. 5.

Referring to FIGS. 2 and 5, an apparatus 40 is illustrated. Apparatus 40 may be characterized as a stuffing box, although apparatus 40 may be more precisely referred to as a seal housing rather than a stuffing box, as the apparatus 40 need not form a seal between the polished rod and the tubular shaft, as such seal may be achieved within the drive head or above the drive head with a top-mounted stuffing box. Apparatus 40 has a stationary housing 44, a tubular shaft 94, and a dynamic seal or seals 62. Referring to FIG. 5, the stationary housing 44 defines a polished rod passage 46. The tubular shaft 94 is mounted, for example via bearing 52, to rotate within the polished rod passage 46 relative to the stationary housing 44. The dynamic seal 62 is mounted to the stationary housing 44 and encircles the tubular shaft 94 within the polished rod passage 46. In some cases, the apparatus 40 forms a stuffing box.

Figure 4:
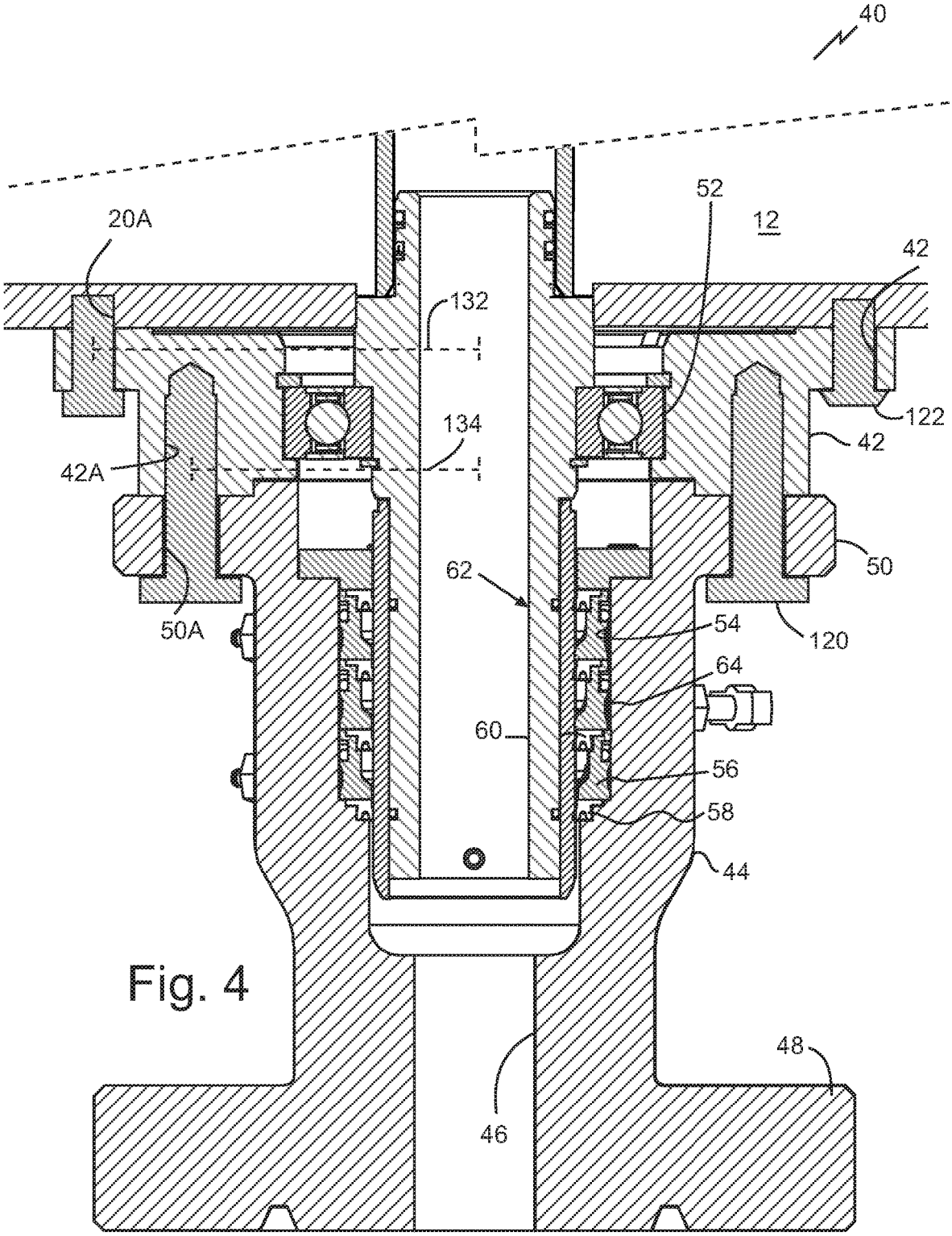
FIG. 4 is a view taken along the 4-4 section lines of FIG. 3.

Referring to FIGS. 4 and 5, apparatus 40 may form a part of the infrastructure of a production well. A drive head 12 may mount in an integral configuration to the stationary housing 44 or flange collar 42. Drive head 12 may be connected to pump fluid from a well, for example by rotating a polished rod 26, which extends from drive head 12 down a well and connects to a submersible pump such as a progressive cavity pump 34 (FIG. 1A). Polished rod 26 may extend through apparatus 40, for example through tubular shaft 94 and polished rod passage 46. Referring to FIG. 5, apparatus 40 may connect to a drive shaft 116 of drive head 12, and drive shaft 116 may be directly connected to a motor of the drive head 12, or may be indirectly connected for example via a suitable transmission, such as gearbox 124 with a drive gear 126, of drive head 12. Polished rod 26 may be mounted for torque transfer to the drive head, for example the drive shaft 116, via a suitable mechanism, such as by an interference fit or a torque connector pin 128.

Referring to FIGS. 2, 3, 7, and 8, drive shaft 116 and tubular shaft 94 may mate for torque transfer via a suitable mechanism. In the example shown the drive shaft 116 depends from the drive head 12 and connects to, for example interlocks with, tubular shaft 94 via a drive head drive shaft connector. Tubular shaft 94 may define, or in some cases mount, the drive head drive shaft connector, such as drive-shaft-finger-receiving key slots 112B, which mate with axial key tabs 116A of shaft 116. Slots 112B may be radial slots, for example machined into a top shelf surface 112A, in this case of a flange 112, of shaft 94. Shelf surface 112A may also define a pin aperture 112C for fitting a pin 118 to abut against and secure tabs 116A within slots 112B. Tabs 116A may depend from a base surface 116B of shaft 116, the base surface 116B resting upon the top shelf surface 112A of flange 112 in use. In some cases (not shown) a torque transfer connection between the drive shaft 116 and tubular shaft 94 is achieved through corresponding out-of-round, for example polygonal, cross-sectional mating profiles. Shaft 116 and shaft 94 may form a stationary seal, for example via gaskets such as o-rings 98 within respective annular grooves or slots 105 in shaft 94 and/or shaft 116.

Referring to FIGS. 1A and 5, apparatus 40 may be installed to a wellhead 25 by a suitable procedure. Stationary housing 44 may be mounted, for example bolted, to a wellhead 25 at a top of a well that penetrates a subterranean formation. The housing 44 may be mounted indirectly to the wellhead 25, for example bolted via bolts passed through bolt holes 48A in a base flange 48 at a base end 44B of housing 44, on a flow tee, blowout preventer, or other equipment that forms part of the production tree. Referring to FIG. 5, flange collar 42, if present, may be mounted onto housing 44 before, during, or after housing 44 is mounted on the wellhead. Tubular shaft 94 may be mounted in flange collar 42, if present, or in housing 44, before, during, or after housing 44 is mounted on the wellhead. Shaft 94 may be mounted to rotate within stationary housing 44. One or more dynamic seals 62 may be mounted before, during, or after mounting housing 44 to the wellhead. The drive head 12 may be mounted to flange collar 42, if present, or housing 44, with a polished rod 26 passing through the shaft 94 and housing 44 to connect between the drive head 12 and a downhole pump 34 (FIG. 1A). The drive head 12 may then be operated to rotate polished rod 26 and pump fluid from the well.

Referring to FIGS. 2 and 5, apparatus 40 may comprise a flange collar 42 for connecting the housing 44 to the drive head 12. A flange collar 42 may be used for one or more of several purposes. One, the use of a flange collar 42 may permit a housing 44 to be adapted for integral fitting to any drive head 12, when the housing 44 is incompatible with the drive head 12. To achieve such a purpose the flange collar 42 may be adapted to interface between the drive head 12 and housing 44. Two, the flange collar 42 may anchor the shaft 94 and lengthen the seal housing/apparatus 40 and tubular shaft 94. Thus, if the rod 26 forces the tubular shaft 94 to angle from center, the dynamic seals 62, which are located near a base end 94B of shaft 94, are more likely to maintain a seal as the shaft 94 is angled, than if a shorter shaft 94 or a central anchor point were used, as the movement of shaft 94 adjacent seals 62 is more akin to a purely radial movement than a pivoting movement.

Figure 3:
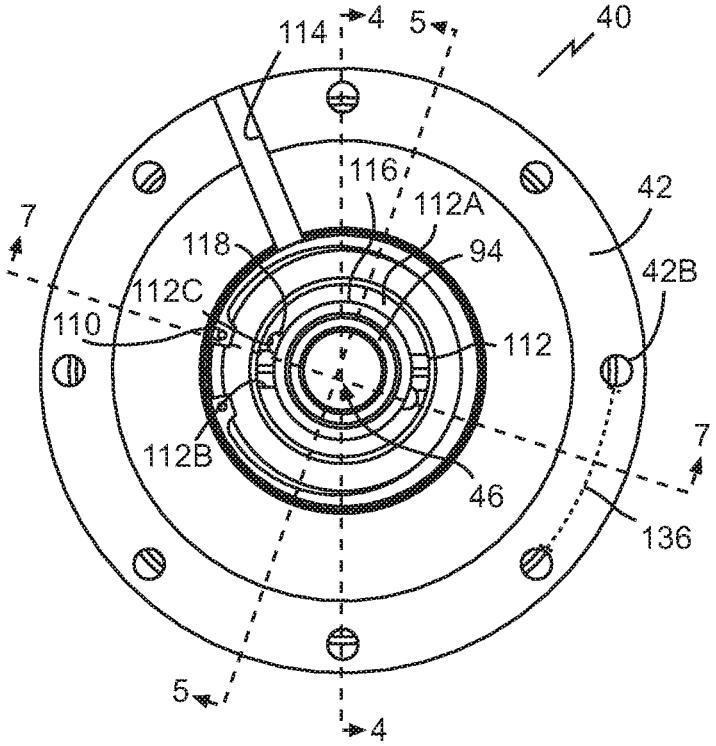
FIG. 3 is a top plan view of the seal housing of FIG. 2.

Referring to FIGS. 4 and 5, flange collar 42 may mount to stationary housing 44 and drive head 12 via a suitable method, for example by fasteners such as bolts 120 and 122. Referring to FIGS. 3 and 4, flange collar 42 may define a first circumferential array of bolt holes 42B, for example on a top face 42C of flange collar 42, for connecting to drive head 12, for example a corresponding circumferential array of bolt holes 20A on drive head 12. Referring to FIG. 5, flange collar 42 may comprise a second array of bolt holes 42A, for example on a base face 42D of flange collar 42, for connecting to housing 44, for example a corresponding array of bolt holes 50A on an upper flange 50 of housing 44. Bolts 120 and 122 may pass through corresponding first arrays of bolt holes 42B, 20A and corresponding second arrays of bolt holes 42A, 50A to secure drive head 12 and housing 44, respectively, to collar 42.

Figure 8:
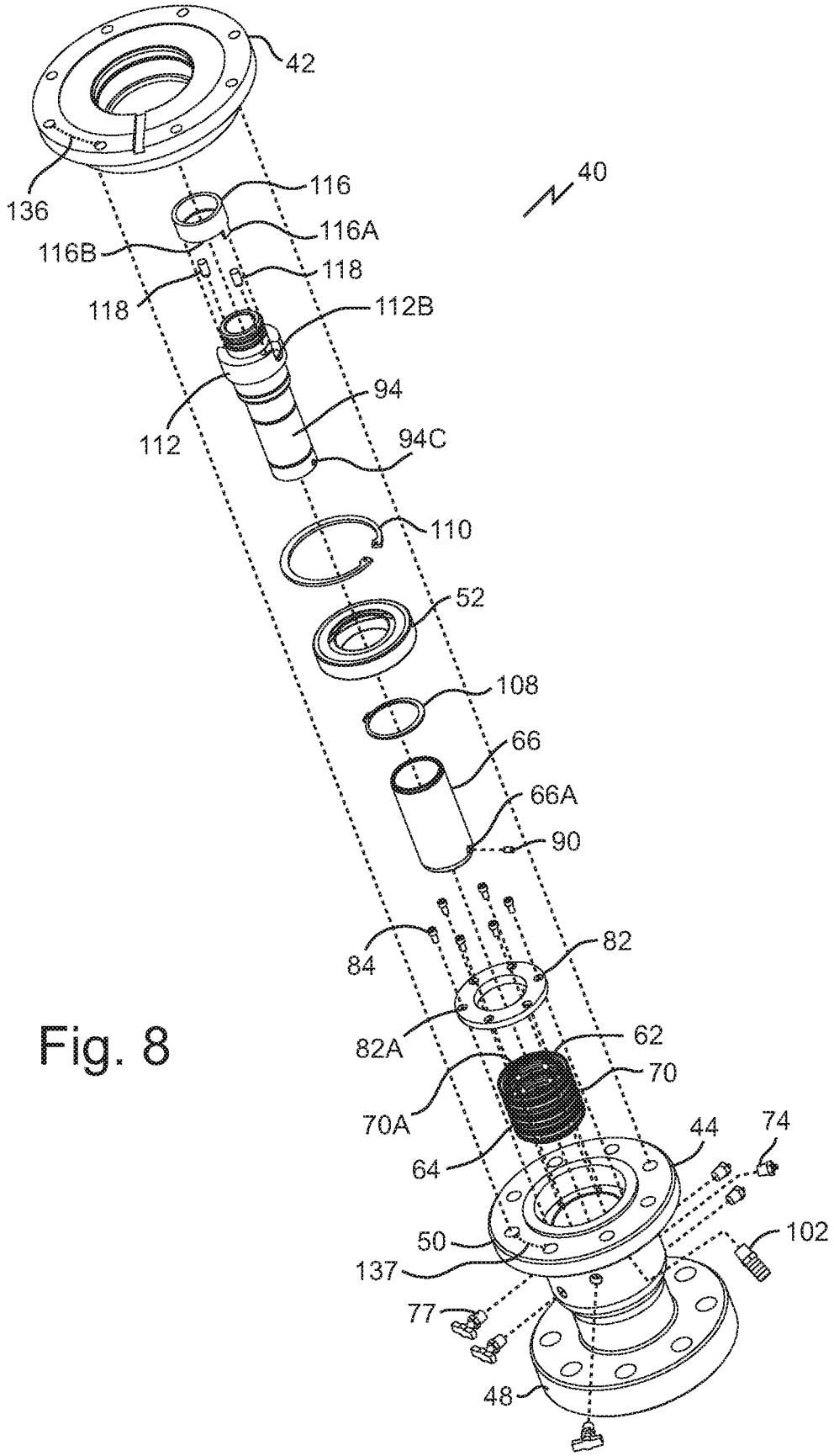
FIG. 8 is an exploded perspective view of the seal housing of FIG. 2.
Figure 9:
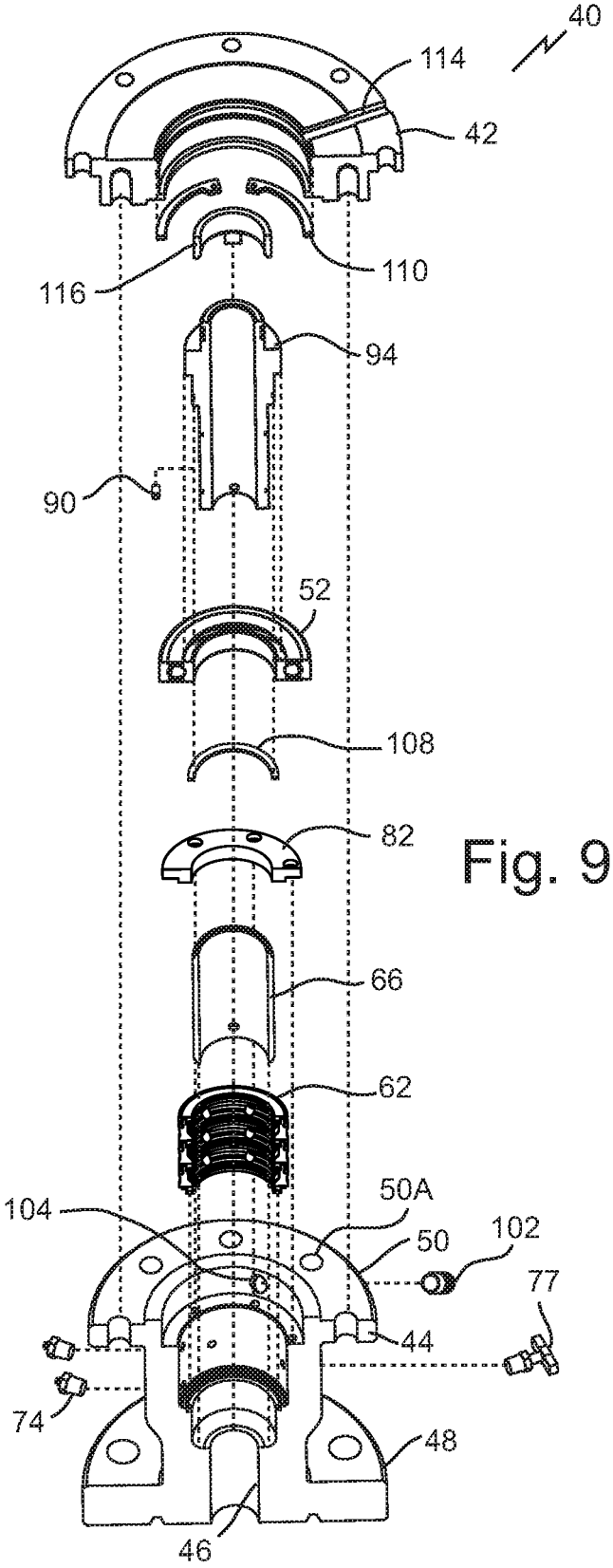
FIG. 9 is an exploded perspective section view of the seal housing of FIG. 2.

Referring to FIG. 4, the adapter plate/flange collar 42 may permit an integral configuration between a housing 44 and a drive head 12 whose respective bolt hole arrays are incompatible. The first arrays of bolt holes 42B, 20A may be incompatible with second arrays of bolt holes 42A and 50A. Incompatibility may be the result of an incompatibility in one or a variety of characteristics of the bolt hole arrays. For example, a radius 132 of array of bolt holes 42B may be wider or narrower than a radius 134 of the second arrays of bolt holes 42A and 50A. Referring to FIGS. 2 and 8, an angular spacing 136 between respective bolt holes of array of bolt holes 42B, 20A may be larger or smaller than an angular spacing 137 between respective bolt holes of second arrays of bolt holes 42A, 50A. In some cases, spacing 136 may be such that less than fifty percent, in this case zero percent, of the bolt holes in second arrays of bolt holes 42A, 50A align with the bolt holes of first array of bolt holes 42B. Referring to FIG. 4, during installation of apparatus 40, a user may select, modify, or construct a flange collar 42 such that the array of bolt holes 42B of the flange collar matches an array of bolt holes 20A of drive head 12 to provide the corresponding first arrays of bolt holes. Varying the sizing, spacing and radius of bolt holes 42B may permit apparatus 40 to be mounted to drive heads of various shapes and sizes.

Referring to FIG. 5, flange collar 42 may mount the tubular shaft 94 for rotation. Flange collar 42 may comprise a bearing, such as a rolling element bearing 52, that secures to tubular shaft 94. Bearing 52 may permit rotation of shaft 94 relative to collar 42 and housing 44. Rolling element bearing 52 may comprise a moving part, such as an inner race 52A and bearing elements 52C. Bearing 52 may comprise a stationary part, such as an outer race 52B. Bearing 52 may comprise a bearing element 52C, such as rollers or balls, contained between the races to allow the inner race 52A to move relative to the outer race 52B. The bearing 52 may be mounted by a suitable method to the flange collar 42, for example by resting between a shelf 47 and locking split ring 110. Bearing 52 may fit around the shaft 94 between a bearing ring seat 108, such as a split ring as shown, and flange 112.

Referring to FIG. 5, apparatus 40 may permit floating movements in radial directions of tubular shaft 94 during operation of the apparatus 40. Tubular shaft 94 may be mounted to the apparatus 40 at an anchor point 138, such as a point that is at, near, or above in this case, a top end 44A of housing 44, for example if anchor point 138 is defined by bearing 52. Anchor point 138 may be located at or adjacent a top end 94A of shaft 94. Tubular shaft 94 may comprise a free base end 94B depending from anchor point 138. Apparatus 40 may be structured such that free base end 94B is permitted to float in radial directions, such as radial directions 143, within the polished rod passage 46, while still maintaining a seal against dynamic seals 62. Tubular shaft 94 may be mounted to float in response to contact with polished rod 26. In some cases, tubular shaft 94 is mounted to permit a floating distance 130 in radial directions measured from a central position, for example of at least 4 thousandths of an inch, or more. To assist in floating, polished rod 26 may be mounted to drive head 12 independent of tubular shaft 94, for example if the rod 26 and shaft 94 have no mating or interlocking parts, and the rod 26 mates with the drive shaft 116 as shown.

Referring to FIG. 5, the bearing 52 may support and define a pivot/anchor point 138 for tubular shaft 94 within flange collar 42. Tubular shaft 94 may comprise an annular flange 112 that rests axially on an upper shoulder 52D of bearing 52 to hang shaft 94 from bearing 52. Upper shoulder 52D may be defined by the inner race 52A of bearing 52. In some cases, bearing 52 is the only bearing that mounts shaft 94 to the apparatus 40, with no other rigid bearing connections therebetween.

Referring to FIG. 5, apparatus 40 may permit floating movements in radial directions of rod 26 within tubular shaft 94 during operation of the apparatus 40. An interior 94D of tubular shaft 94 may be oversized, for example of a sufficiently larger diameter 95 than a diameter 97 of rod 26, to permit rod 26 to float in radial directions within shaft 94. In some cases at least 4 thousandths of an inch of radial floating from center may be used, or greater amounts of floating may be used. By permitting one or both of floating of shaft 94 within housing 44 and rod 26 within shaft 94, the apparatus 40 may permit a reliable and effective dynamic seal upon a rod 26 that deviates from center such that a central axis 26A of rod 26 defines a non-zero angle 99, for example of up to twenty degrees or more, with a central axis 46A of one or both the polished rod passage 46 and the tubular shaft 94 during use.

Referring to FIG. 5, shaft 94 may comprise a sacrificial part that contacts the dynamic seals 62 in use. One example of a sacrificial part is a wear sleeve 66. Wear sleeve 66 may comprise an outer cylindrical wall 68 that contacts the dynamic seal 62. A wear sleeve may be made of hardened material relative to the material the makes up the shaft 94. The wear sleeve may effectively line an outer cylindrical wall 69 of the shaft 94. Wear sleeve 66 and shaft 94 may be secured together by a suitable fashion, such as a set screw 90 that passes through aligned radial apertures 66A and 94C in the wear sleeve 66 and shaft 94, respectively.

Referring to FIGS. 5, 5A, 6 and 7, each dynamic seal 62 may have a suitable structure for forming a dynamic seal against the outer cylindrical wall 68 (of the wear sleeve 66) of the shaft 94. Each dynamic seal 62 may comprise a retainer ring 64 that mounts an annular lip seal 60 that contacts the shaft 94 in use. Dynamic seal 62 may comprise a plurality of dynamic seals stacked axially one on top of the other, for example with a base surface 64B of each ring 64 resting upon a top surface 64A of an adjacent ring 64. Retainer rings 64 may be made of a rigid material such as metal, while lip seals 60 may be made of a flexible or resilient material such as rubber to facilitate seal formation on contact with shaft 94.

Figure 7:
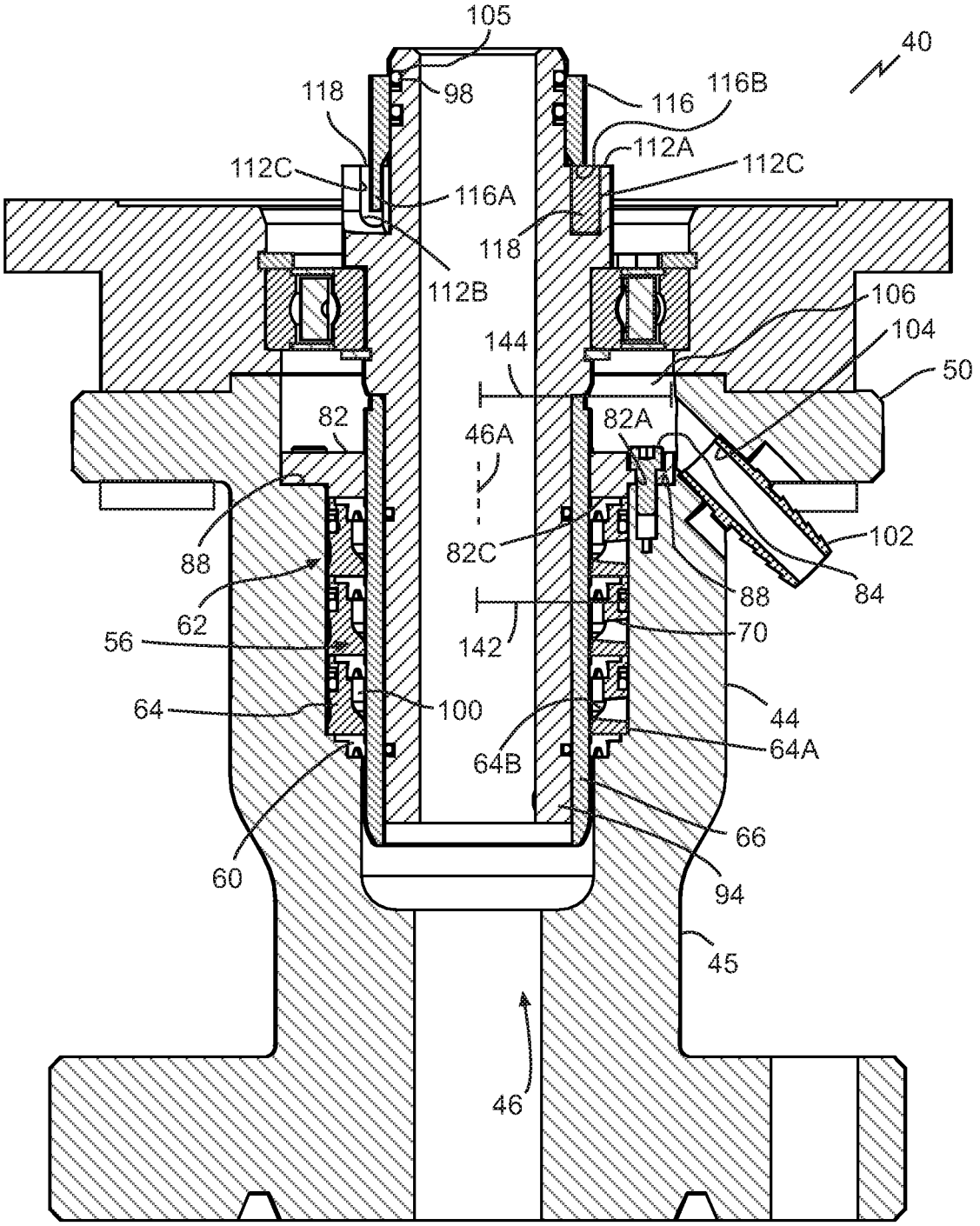
FIG. 7 is a view taken along the 7-7 section lines of FIG. 3.

Referring to FIGS. 5, 7, and 8, apparatus 40 may comprise a seal compressor part 82 to improve the sealing effect of seal or seals 62 against tubular shaft 94. Seal compressor part 82, for example forming a ring plate or collar 82B, may be mounted within the polished rod passage 46 by one or more threaded fasteners 84. Collar 82B may define an array of fastener apertures 82A. Fastener apertures 82A may align with respective fastener receiving apertures 88A defined within a collar shelf 88 of the stationary housing 44. As threaded fastener 84 is advanced, seal compressor part 82 may contact and apply an axial force upon dynamic seal 62 to compress a stack of one or more dynamic seals 62 radially inward against shaft 94. Seal 62 may be sandwiched axially between a seal support shelf 58 and seal compressor part 82, such that advancement of part 82 compresses seal 62 between shelf 58 and part 82. In use a user may install dynamic seal 62 and seal compressor part 82 around tubular shaft 94. A user may then initially or periodically tighten or loosen threaded fastener 84 to increase or decrease compression, respectively, of seal 62.

Referring to FIGS. 5 and 7, stationary housing 44 may be structured to facilitate the installation, maintenance, and replacement of dynamic seal 62. Dynamic seal 62 may mount within a first annular cavity 56 defined between the tubular shaft 94, an interior surface 54 of housing 44, and the seal support shelf 58. Collar 82B may mount within a second annular cavity 106 defined between shaft 94, interior surface 54, and collar shelf 88. A base part 82C of collar 82B may depend into the first annular cavity 56 to press axially against the seals 62. Second annular cavity 106 may have a larger radius than first cavity 56. In the example shown if FIG. 7, first annular cavity 56 has a first radius 142 and second annular cavity 106 has a second radius 144 that is greater than first radius 142. In some cases, the radius 142 of first cavity 56 is greater than the radius 144 of second cavity 106. Interior surface 54 may be stepped such that in sequence the seal support shelf 58 defines a base tread, the interior surface 54 of first annular cavity 56 defines a riser, and collar shelf 88 forms an upper tread. Referring to FIG. 5, seals 62 may seal against the interior surface 54 of the housing 44 by gaskets, such as o-rings 80 positioned in annular slots 78 within the retainer rings 64. Positioning o-rings 80 within rings 64 rather than interior surface 54 reduces the machining demands required to make the housing 44. At the base of the stack of seals 62 may be a lip seal 60.

Referring to FIGS. 5, 5A, 6, and 8, each seal 62 may be structured to be one or more of pressurized with fluid, tested for leaks, or drained of fluid. Retainer ring 64 may define a radial passage 70 extending between an outer cylindrical wall 64C and an inner cylindrical wall 64D of ring 64. Retainer ring 64 may define an outer annular groove 70A within outer wall 64C. An annular seal cavity 100 may be defined between tubular shaft 94, inner cylindrical wall 64D, lip seal 60, and in some cases the lip seal 60 of an adjacent seal 62.

Figure 6:
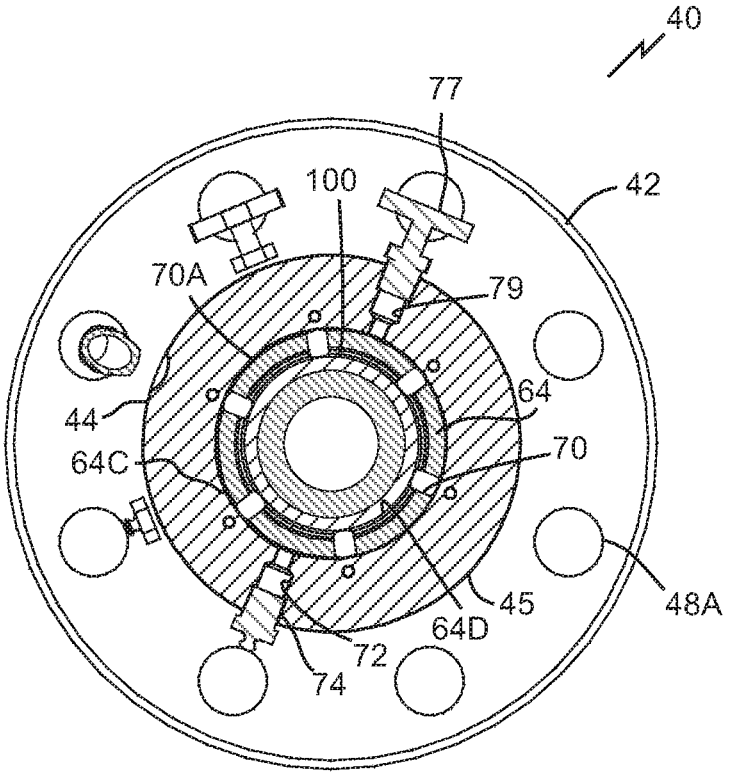
FIG. 6 is a view taken along the 6-6 section lines of FIG. 5.

Referring to FIGS. 5, 5A, and 6, each dynamic seal 62 may be pressurized with fluid, for example to pressurize each annular seal cavity 100 with fluid to increase the efficiency of each dynamic seal 62 and the stack of seals as a whole. One or more fluid injection ports 72 may extend from an external surface 45 of housing 44 into fluid communication with a respective seal 62, for example a respective radial passage 70. Each port 72 may be in fluid communication with a respective annular seal cavity 100 via fluid communication outer groove 70A, and aperture/radial passage 70 of ring 64. Dynamic seals 62 may form a stack of seals that may be independently pressurized by pressurizing a respective annular seal cavity 100 by injecting fluid through a respective fluid injection port 72. Each port 72 may be fitted with a corresponding plug 74, which may have a one-way fluid injection nipple 74B to permit fluid injection without removing the plug 74 from port 72.

Referring to FIGS. 5, 5A, and 6, fluid may be drained from within each dynamic seal 62. A portion or all of fluid may be drained from seal cavity 100 through fluid injection port 72 or a dedicated fluid drain port 79. Port 79 may extend from external surface 45 of housing 44 through housing 44 into fluid communication with radial passage 70, for example via outer groove 70A. Fluid draining may occur substantially simultaneously with pressurization of fluid, so that fluid enters the cavity 100 via port 72 and air, gas, and old fluid exits via drain port 79. Fluid may be drained from each seal 62 periodically for testing purposes, for example to evaluate the status of seal 62, including checking for a seal failure. The structure provided here may permit each seal 62 within a stack of seals to be independently tested by draining a portion of fluid from each respective annular seal cavity 100 through the respective fluid injection port 72 or a respective fluid drain port 79. Independent testing and filling permits seal failures to be isolated without disassembly of the apparatus 40, and assists the user in identifying which seals need replacing or fluid top up. Each port 79 may be fitted with a corresponding plug 77. Plugs may be threaded into place or fitted by other suitable means.

Referring to FIG. 7, apparatus 40 may incorporate various features to address leaks when such occur. For example, housing 44 may comprise a master drain port 104 positioned to drain fluid that leaks past the dynamic seals 62. Drain port 104 may be fitted with a drain nipple 102, which may direct leaked fluids into a suitable collection device such as a pail (not shown) to avoid environmental contamination. Referring to FIG. 2, a drain slot 114 may be present in flange collar 42 to direct any fluid that has leaked onto the flange collar 42, into a suitable collection device such as a pail (not shown).

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An apparatus comprising:

a stationary housing defining a polished rod passage;

a tubular shaft mounted to rotate within the polished rod passage relative to the stationary housing;

a dynamic seal mounted to the stationary housing encircling the tubular shaft within the polished rod passage; and in which the tubular shaft is mounted to the apparatus at an anchor point that is at, near, or above, a top end of the stationary housing, with a free base end of the tubular shaft depending from the anchor point to float in radial directions within the polished rod passage.

2. The apparatus of claim 1 in which the tubular shaft is mounted to permit at least 4 thousandths of an inch of floating in radial directions measured from a central position.

3. The apparatus of claim 1 in which the tubular shaft is mounted at the anchor point to a rolling element bearing, the rolling element bearing having at least a moving part and a stationary part.

4. The apparatus of claim 3 in which the rolling element bearing comprises:

an inner race as the moving part;

an outer race as the stationary part; and rollers or balls.

5. The apparatus of claim 3 in which the rolling element bearing is the only rolling element bearing that mounts the tubular shaft to the apparatus.

6. The apparatus of claim 3 in which the tubular shaft comprises an annular flange that rests axially on an upper shoulder of the rolling element bearing to hang the tubular shaft from the rolling element bearing.

7. The apparatus of claim 1 further comprising a flange collar mounted to the stationary housing, in which the tubular shaft is mounted at the anchor point to the flange collar.

8. The apparatus of claim 7 in which the flange collar is bolted to the stationary housing.

9. The apparatus of claim 1 in which:

a drive head is mounted to the stationary housing;

a polished rod extends from the drive head through the tubular shaft; and the drive head is connected to rotate the polished rod.

10. The apparatus of claim 9 in which an interior of the tubular shaft is oversized to permit the polished rod to float in radial directions within the tubular shaft.

11. The apparatus of claim 10 in which the polished rod is mounted to the drive head independent of the tubular shaft.

12. The apparatus of claim 9 in which a central axis of the polished rod defines a non-zero angle with a central axis of the tubular shaft.

13. The apparatus of claim 9 in which the polished rod is connected to operate a progressive cavity pump located with a well below the apparatus.

14. A method comprising operating a drive head, which is mounted to the apparatus of claim 1 to rotate a polished rod and pump fluid from a well.

15. A method comprising:

mounting a stationary housing defining a polished rod passage to a wellhead at a top of a well that penetrates a subterranean formation, in which a tubular shaft is mounted to rotate within the stationary housing, and a dynamic seal mounted to the stationary housing encircles the tubular shaft within the stationary housing;

mounting a drive head to the stationary housing; and operating the drive head to rotate a polished rod, which passes through the tubular shaft and stationary housing, to pump fluid from the well;

in which a free base end of the tubular shaft floats in radial directions within the polished rod passage in response to contact with the polished rod.

16. The method of claim 15 in which an interior of the tubular shaft is oversized to permit the polished rod to float in radial directions within the tubular shaft.

17. The method of claim 16 in which the polished rod is mounted to the drive head independent of the tubular shaft.

18. The method of claim 15 in which a central axis of the polished rod defines a non-zero angle with a central axis of the tubular shaft.

* * * * *